United States Patent [19]

Bona

[11] Patent Number: 4,731,961

[45] Date of Patent: Mar. 22, 1988

[54] TEMPORARY ISOLATION STRUCTURE

[76] Inventor: Richard R. Bona, 506 Fairfax Ave., San Mateo, Calif. 94402

[21] Appl. No.: 930,780

[22] Filed: Nov. 14, 1986

[51] Int. Cl.[4] ..... E06B 9/00; E06B 3/80; E04B 1/347; E04B 1/86

[52] U.S. Cl. ..... 52/63; 52/71; 52/239; 52/632; 98/31.5; 98/34.5; 135/108

[58] Field of Search ..... 52/63, 71, 239, 632; 55/385 A; 98/31.5, 33.1, 34.5; 135/108; 128/1 R

[56] References Cited

U.S. PATENT DOCUMENTS

| | | | |
|---|---|---|---|
| 246,118 | 8/1881 | Garver | 135/108 |
| 512,333 | 1/1894 | Simmer . | |
| 674,854 | 5/1901 | Crocker . | |
| 1,028,293 | 6/1912 | Sidman . | |
| 2,247,634 | 7/1941 | Houston . | |
| 2,303,725 | 12/1942 | De Ment . | |
| 2,313,659 | 3/1943 | Mittag . | |
| 2,325,923 | 8/1943 | Stelfner . | |
| 2,808,065 | 10/1957 | Ellis | 135/108 |
| 3,083,795 | 4/1963 | Land . | |
| 3,111,723 | 11/1963 | Bates | 52/243 X |
| 3,225,818 | 12/1965 | Wise . | |
| 3,313,562 | 4/1967 | Rice | 52/71 X |
| 3,498,587 | 3/1970 | Friedberg | 52/71 |
| 3,561,518 | 2/1971 | Johnson | 52/63 X |
| 3,566,556 | 3/1971 | Nichols | 52/71 |
| 3,601,031 | 8/1971 | Abel et al. | 98/33.1 X |
| 3,631,640 | 1/1972 | Dunne . | |
| 3,807,112 | 4/1974 | Perina . | |
| 3,824,987 | 7/1974 | Howorth | 98/33.1 X |
| 4,041,667 | 8/1977 | Lindner . | |
| 4,047,337 | 9/1977 | Bergstrom | 52/71 |
| 4,103,463 | 8/1978 | Dixon . | |
| 4,127,196 | 11/1978 | Boucher . | |
| 4,304,224 | 12/1981 | Fortney | 98/34.5 X |
| 4,357,979 | 11/1982 | Morontate . | |
| 4,369,827 | 1/1983 | Anderson . | |
| 4,485,489 | 12/1984 | Pilie et al. . | |
| 4,546,889 | 10/1985 | Schoumaker et al. | 52/239 X |

FOREIGN PATENT DOCUMENTS

| | | | |
|---|---|---|---|
| 2501272 | 7/1976 | Fed. Rep. of Germany | 52/71 |
| 2844751 | 4/1979 | Fed. Rep. of Germany | 52/63 |
| 94604 | 8/1969 | France | 52/71 |

*Primary Examiner*—Alfred C. Perham
*Attorney, Agent, or Firm*—Burns, Doane, Swecker & Mathis

[57] ABSTRACT

Components for providing temporary walls to environmentally isolate a selected area of a room from the remainder of the room include telescopically adjustable stanchions that support upright sidewalls formed of flexible sheet material. The stanchions include hinged flange members that are mounted to provide planar surfaces parallel to the longitudinal axis of the stanchions for sealing attachment to the flexible sheet material.

19 Claims, 8 Drawing Figures

TEMPORARY ISOLATION STRUCTURE

BACKGROUND OF THE INVENTION

1. Field of the Invention

The present invention relates to isolation structures and, more particularly, to components for providing temporary walls for isolation structures.

2. State of the Art

In modern manufacturing and construction operations, it is often necessary to provide substantially contaminant-free environments. Such environments, sometimes referred to as "clean rooms", generally comprise enclosures that isolate a selected area from the surrounding environment such that the atmosphere within the isolated area has substantially fewer airborne particulates and other contaminants than the environment exterior to the isolated area.

Most clean rooms are intended to be permanent structures, even though circumstances often arise that require reconfiguration of clean rooms or that require only a temporary isolation structure or a structure that can be conveniently increased in size or otherwise reconfigured. Because construction of clean room-like environments is complex, the time required for re-construction or reconfiguration of clean rooms may cause substantial delays in projects as well as considerable expense and other inconveniences. This is particularly true where construction requires movement of large items of equipment or substantial modifications to existing structures.

To avoid the cost and inconvenience of constructing permanent clean room structures, attempts have been made to provide temporary isolation enclosures. However, construction of temporary enclosures that provide substantial protection against contaminant intrusion is not a simple matter and usually involves unique construction practices. For example, in circumstances where the concentration of airborne particulate contamination must be minimized, the interior of an isolating enclosure usually cannot have exposed particulating surfaces, because particulates from the surfaces can increase airborne contaminants to unacceptably high levels. Currently, temporary isolation structures are often constructed with timber and clear plastic sheet material know in the construction trade as Visqueen construction plastic; however, both timber and such plastic materials may be particulating in the sense that they may release particles, often of sub-micron size, to their immediate environment. Thus, in current practice, temporary isolating structures may contribute contamination of the type that the structures are intended to prevent.

In view of the preceding discussion, it can be appreciated that there exists a substantial need for improved ways and means of constructing temporary isolation structures. It should be noted that such temporary isolation structures may even be used within clean rooms or other structures that have controlled environments. For example, in situations where a machine requires dismantling within a controlled environment, it is often desirable to provide a temporary isolating structure around the dismantled machine to prevent release of particulates into the controlled environment.

OBJECTS AND BRIEF SUMMARY OF THE PRESENT INVENTION

In accordance with the preceding discussion of the prior art, a primary object of the present invention is to provide components to conveniently construct walls for temporary structures that environmentally isolate a selected area of a room from the remainder of the room.

More particularly, an object of the present invention is to provide reusable and adjustable components to construct temporary walls that can be readily expanded, contracted, and otherwise reconfigured.

Still more particularly, an object of the present invention is to provide reusable and adjustable components to construct temporary walls that are adjustable in height to accommodate placement of isolating structures in rooms that have various ceiling elevations.

In a preferred embodiment of the present invention, components are provided to form a temporary wall structure that can serve to environmentally isolate a selected area of a room from the remainder of the room. The components generally include telescopically adjustable stanchions that each have a base member and a member that is extendably received in the base member, hinged flange members that are mounted to each stanchion to provide planar surfaces that extend generally parallel to the longitudinal axis of the stanchions, and means to sealingly attach flexible sheet material to the flange members to form sealing walls extending between adjacent stanchions.

The foregoing and other objects of the present invention can be readily ascertained by reference to the following description and attached drawings which illustrate the preferred embodiments. In the following description, it will be seen that a primary benefit and advantage of the present invention is to provide components that can be conveniently installed to form temporary isolation walls. It will also be seen that another advantage of the present invention is to provide adjustable components to form temporary isolation walls whose configuration can be easily changed while maintaining environmental integrity.

DETAILED DESCRIPTION OF THE PREFERRED EMBODIMENT

Figures 1, 2:
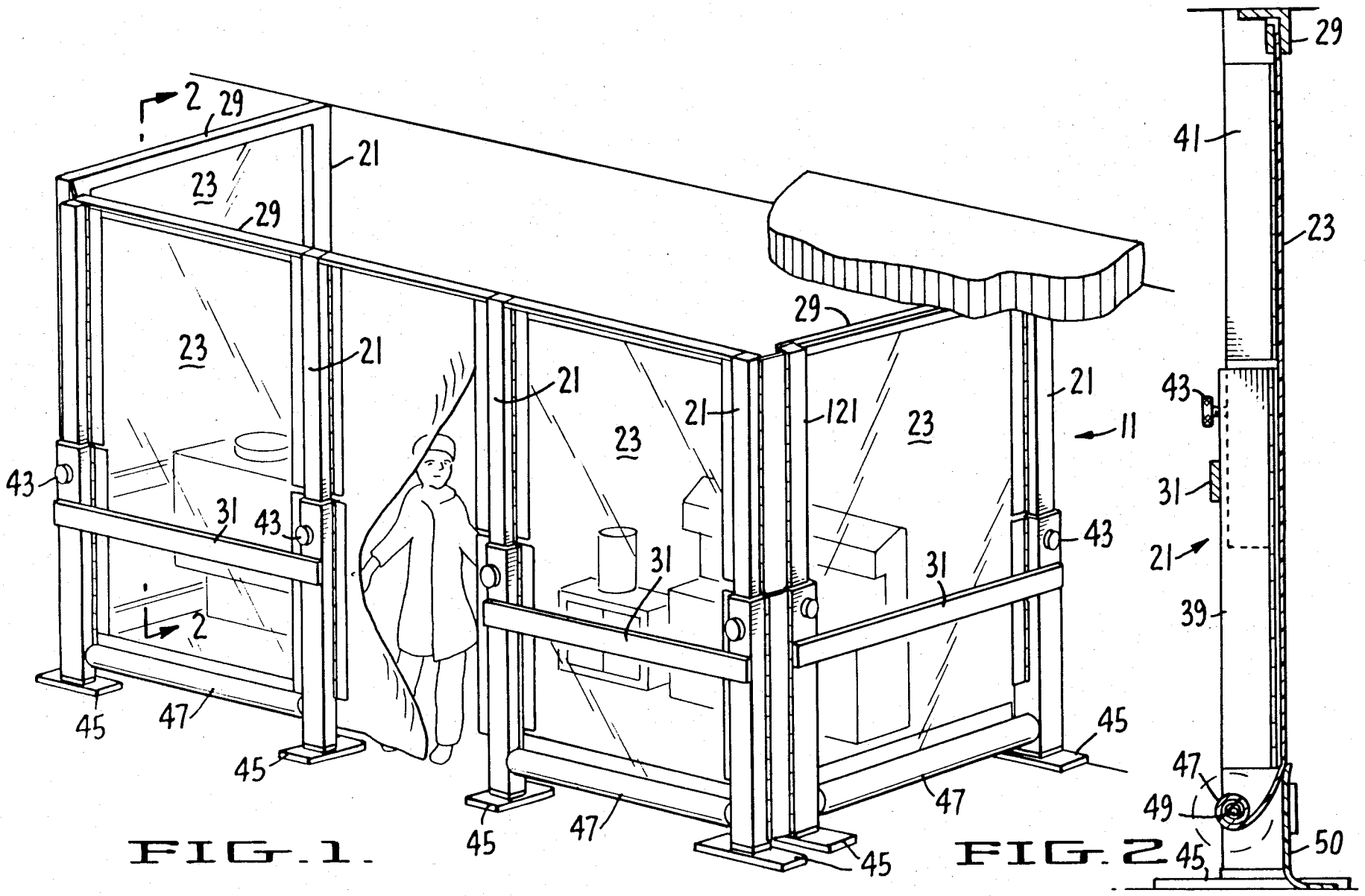
FIG. 1 is a perspective view of a temporary isolation structure constructed with components according to the present invention.
FIG. 2 is a side view, partially in cross-section, of a stanchion member that forms a component of the structure of FIG. 1.

FIG. 1 shows a temporary structure, generally designated 11, that serves to environmentally isolate a selected area of a room from the remainder of the room. The perimeter of temporary isolation structure 11 is defined by upstanding stanchions 21, and the sidewalls 23 of the structure comprise flexible sheets of material that are sealingly connected between the stanchions. As will be explained in detail in the following, the stanchions 21 are selectively adjustable in length and can be connected to one another by cross-frame members 29 and by intermediate bracing members 31.

The number and spatial configuration of the upstanding sidewalls 23 that are provided by the isolation structure are a matter of choice. In the embodiment illustrated in FIG. 1, for example, there are four temporary sidewalls 23 and a door flap 24 that together encompass a section of a permanent wall 33 of the room in which the isolation structure 11 is formed. In other embodiments, isolation structure 11 may be freestanding and, therefore, need not integrate a permanent wall. In still other embodiments, the isolation structure may incorporate two or more permanent walls of a room as, for example, when stanchions 21 are placed to provide a configuration that spans completely across a room or when the stanchions are located to employ the corner of a room to provide two walls for the isolation structure.

FIGS. 2–6 show a typical one of the stanchions 21. In this embodiment, stanchion 21 is generally includes a tubular base member 39 of rectangular cross-section and a telescopic member 41, also of rectangular cross-section, that is dimensioned to be extendably received by base member 39. The extended position of telescopic member 41 relative to base member 39 is fixed by a screw-like mechanism 43 fitted through the sidewall of tubular base member 39 to engage telescopic member 41 in the manner of a set screw. In upright position, therefore, stanchion 21 provides a column that is adjustable in height to accommodate rooms having different ceiling elevations.

In practice, it has been found convenient to mount a foot plate 45 to the lower end of base member 39 of stanchion 21 as shown in FIGS. 1 and 2. Preferably, foot plate 45 has a rectangular configuration and is pivotable in a plane perpendicular to the longitudinal axis of the stanchion. As such, foot plate 45 can be selectively placed in various positions to increase the stability of stanchion 2 while evenly distributing its load across a floor.

As also shown in FIGS. 1 and 2, a roll 47 of the flexible sheet material that forms sidewalls 23 can be mounted on a rotatable axle 49 supported between adjacent stanchions 21 at floor level so that the sheet material can be conveniently unrolled as the stanchions are extended. If desired, roll 47 may be encased in an optional canister (not shown) to provide protection of the unrolled sheet material from contamination or to isolate a contaminated sheet upon removal of a sidewall. Further, a flexible sealing flap member 50 can be mounted across the lower ends of the stanchions to form a seal with the floor to prevent contaminants from passing beneath the lowermost edge of the sidewalls 23.

Figure 3:
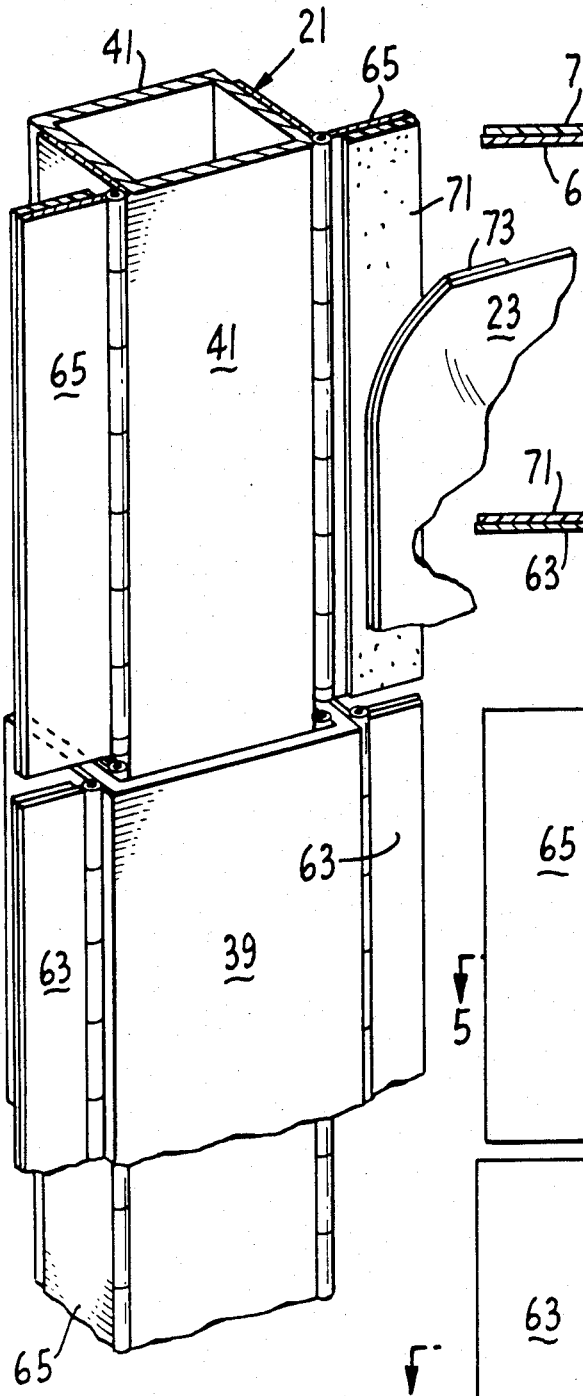
FIG. 3 is a pictorial view, partially cutaway, of a portion of the stanchion of FIG. 2.
Figure 4:
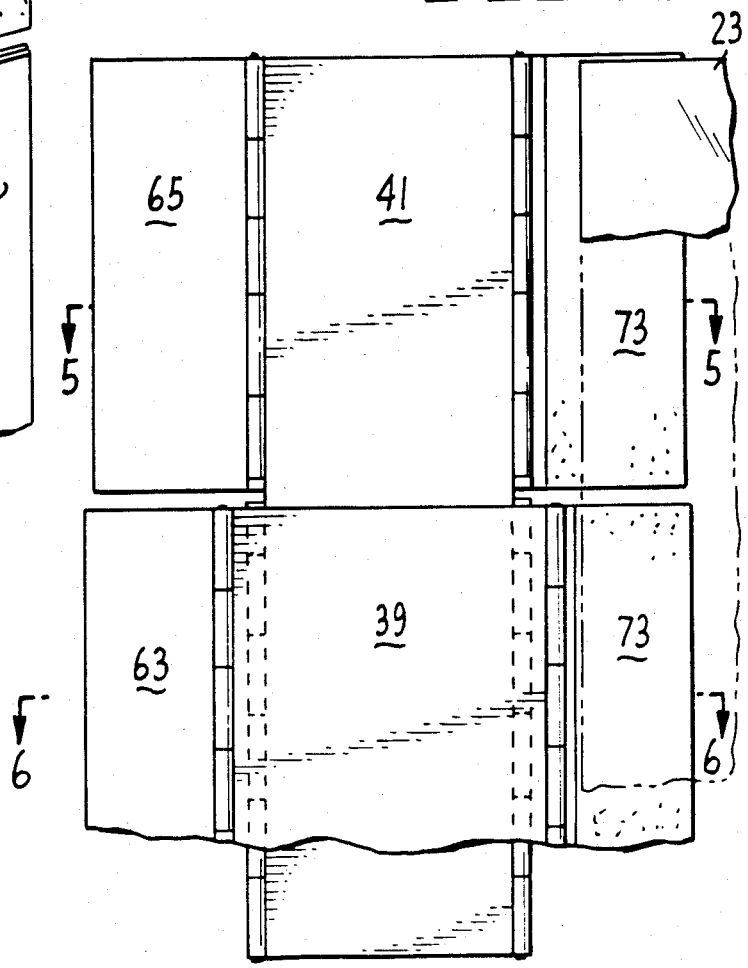
FIG. 4 is a front view of the stanchion of FIG. 3.

FIGS. 3–6 particularly show devices for connecting the flexible sheet material to stanchions 21 to provide sidewalls 23. In this embodiment, the connection devices comprise a first set of flange members 63 that are hinged to the sides of base member 39 in a position to provide at least two planar surface that extend, in all pivotal positions, parallel to the longitudinal axis of the base member. Further, the connection devices include a second set of flange members 65 that are hinged to a side of the telescopic member 41 and positioned to provide a planar surface that extends, in all pivotal positions, parallel to the longitudinal axis of the telescopic member. For reasons which will become evident when construction of a wall with the stanchions 21 is described, telescopic members 41 are paired with base members 39 so that for each pair, the hinge pins for the flange members 65 mounted to the telescopic members 41 are generally in vertical alignment with the hinge pins for flange members 63 mounted to the base member 39. Further, as best shown in FIGS. 3 and 4, the width of flange members 65 preferably slightly exceeds the width of flange members 63 such that the flange members all extend to approximately the same distance from the stanchion so that their outward edges are in general vertical alignment parallel to the longitudinal axis of the stanchion.

Figure 5:
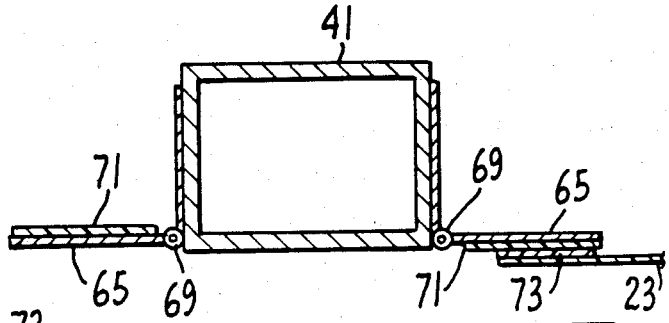
FIG. 5 is a transverse cross-sectional view taken along the lines 5—5 in FIG. 4 for viewing in the direction of the arrows.
Figure 6:
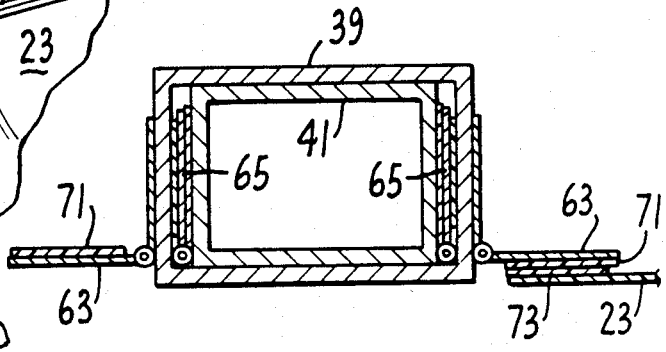
FIG. 6 is a transverse cross-sectional view taken along the lines 6—6 in FIG. 4 for viewing in the direction of the arrows.

FIGS. 5 and 6 illustrate the preferred geometrical relationship in which flange members 65 are mounted to telescopic member 41. More particularly, flange members 65 are located for pivotable movement to positions flush against the sides of telescopic member 41 whereby the telescopic member 41 together with the flange members can be telescopically received within the base member 39. To accomplish this relationship, hinge pins 69 of the flange members 65 are mounted adjacent to, and parallel with, two of the vertical edges of the telescopic member. Also, as best shown in FIG. 6, the inside diameter of base member 39 is such that flange members 65 can be accommodated within the base member when they are rotated to positions flush against the sidewalls of telescopic member 41.

FIGS. 3–6 further illustrate attachment devices by which flexible sheet material is attached to the flange members. In accordance with the illustrated embodiment, the attachment devices preferably include strips 71 of magnetic material that are bonded to the faces of the flange members and similar strips 73 of magnetic material bonded along the side edges of the flexible sheets. In practice, the magnetic material in both strips 71 and 73 is magnetized but it is contemplated that only one strip needs be magnetized so long as the other is formed of a ferromagnetic material. It should also be understood that strips 71 of magnetic material can be mounted to either, or both, faces of flange members 63 and 65.

Figure 7:
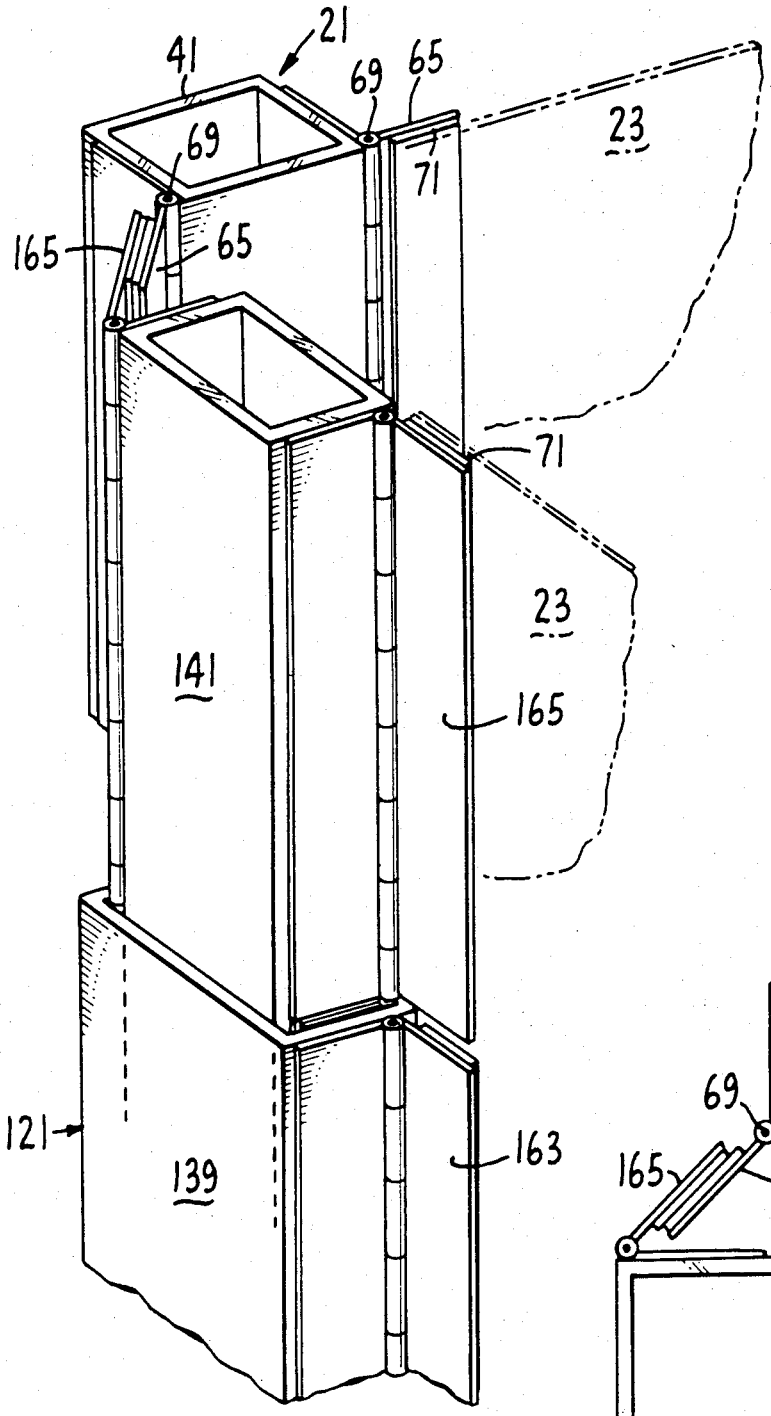
FIG. 7 is a pictorial view of a connected pair of stanchions including one of the type previously illustrated and one of a modified type.
Figure 8:
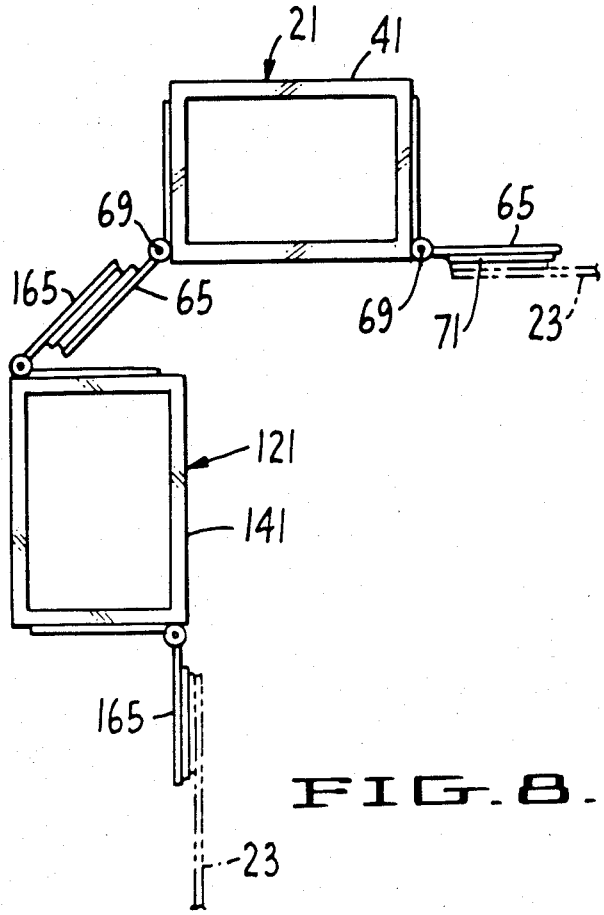
FIG. 8 is a top view of the connected stanchions of FIG. 7.

FIGS. 7 and 8 show a connected pair of stanchions 21 and 121 respectively. Stanchion 121 includes tubular base member 139 and telescopic member 141 and differs from stanchion 21 only in that the hinges of flange members 163 and 165 on stanchion 121 are mounted at diametrically opposite edge corners of the stanchion rather than being aligned across a sidewall as on stanchion 21. Generally speaking, such structure permits stanchion 121 to be readily connected to a stanchion 21 to change the direction of a wall while still maintaining sealing integrity. More particularly, the construction of stanchion 121 permits its flange members 161 and 165 to be magnetically coupled to flange member 63 and 65 on the stanchion 21 in a manner that provides more angular flexibility than if the connected stanchions were identical. Thus, stanchions 21 and 121 can be readily coupled to provide virtually any desired wall configuration.

The steps involved in construction of a temporary isolation wall structure within a room with the above components will now be described. As the first step, stanchions 21 are arranged in upstanding condition with the spacing between the stanchions sufficient to accommodate the precut width of the roll 47 of flexible sheet material and with the foot plates 45 pivotably adjusted to convenient positions to stabilize the stanchions. The corners, if any, of the wall structure are provided by mating stanchions 21 and 121 as shown in FIGS. 7 and 8. As a next step, the end edges of the sheet material on rolls 47 are fixed to cross-members 29, and telescopic members 41 are adjustably extended to the desired height and secured in position b tightening the screw-like mechanisms 43. At this stage, the flexible sheet material is unrolled and hangs loosely between stanchions. With the stanchions so arranged, flange members 61 on telescopic members 41 are pivoted to be generally parallel to the sheet material to engage the magnetic edge strips on the sheet material. Similarly, flange members 63 on base members 39 are pivoted to engage the magnetic strips 73 on the edges of the sheet material. The final assembly comprises a sealed wall that effectively provides a barrier to air-borne particulates.

At this juncture, it can be appreciated that, with telescopic members 41 extended to the desired height, flange members 65 are free to pivot only if the lower edges of the flange members are clear of the upper end of the tubular base member 39. In practice, the nominal vertical length of flange members 65 is about four feet and, if clearance is not initially available for the flange members to pivot, they are cut across the top of the base member. This allows the extended portions of the flange members to freely pivot while the unextended portions remain in the base member.

Preferably, the materials of construction of stanchions 21 and 121 are aluminum, although other rigid and lightweight materials can be used. Also, for purposes of providing light weight and strength, it is convenient to have the telescopic members 41 formed of tubular material. In practice, base members 39 have cross-sectional exterior dimensions of approximately two inches by three inches, with a sidewall thickness of about one-eighth inch.

Although the present invention has been described with particular reference to the illustrated embodiments, such disclosure should not be interpreted as limiting. Various other alterations and modifications will no doubt become apparent to those skilled in the art after having read the preceding disclosure. For example, although the magnetic means for attaching the flexible sheet material to the flanges is preferred, other attachment means may be used. As another example, the flexible sheet material is preferably formed of plastic, but nylon mesh or other materials can be used. As still another example, although the base members and the telescopic members are preferably rectangular in cross-section, other configurations can be provided. As yet another example of a modification, additional telescoping members can be added to the stanchions to permit further adjustable extension of their height. For another example, the stanchions may be provided with respective internal grooves or tracks and the edges of the flexible sheets may be provided with a complementary cross-section in bolt-rope fashion wherein the edges of the sheet are laterally secured within the grooves but are free to slide up and down. In view of such variations and others, it is intended that the appended claims be interpreted as covering all alternative embodiments and equivalents as fall within the spirit and scope of the present invention.

What is claimed is:

1. Components to form temporary walls to environmentally isolate a selected area of a room from the remainder of the room comprising:

(a) a pair of spaced-apart stanchion means each including a base member and a telescopic member that is extendably received in the base member, and means to adjustably fix the position of the base member relative to the telescopic member;

(b) a first set of flange members hinged to sidewalls of each base member and a second set of flange members hinged to sidewalls of each telescopic member to provide generally planar surfaces extending parallel to the longitudinal axis of each respective spaced-apart stanchion means the surface of the second set of flange members in generally vertical alignment with the surface of the first set of flange members;

(c) means extending between the spaced-apart stanchion means; and (b) attachment means to sealingly attach the means extending between the spaced-apart stanchion means to the planar surfaces of each of the first and second sets of flange members such that a temporary isolating wall can be formed within a selected area of a room by selectively placing the stanchion means upright at spaced-apart locations, extending the telescopic members to selected elevations, and fixing opposite edges of the means extending between the spaced-apart stanchion means to the flange members by the attachment means to form an upright sidewall sealed between the adjacent pair of stanchion means.

2. Components according to claim 1 wherein flange members of the second set are pivotable to a position flush against the sides of the telescopic member.

3. Components according to claim 2 wherein the attachment means includes magnetic material bonded to the planar surfaces of the flange members.

4. Components according to claim 1 wherein said means that extends between spaced-apart stanchion means includes flexible sheet material.

5. Components according to claim 4 wherein the attachment means further includes magnetic material bonded to the edges of the flexible sheet material.

6. Components according to claim 5 wherein the magnetic material includes magnetized ferromagnetic particles embedded in flexible strips of material.

7. Components according to claim 1 wherein the base member and the telescopic member are both generally rectangular in transverse cross-section.

8. Components according to claim 7 wherein flange members of the first set are fixed to two opposed sidewalls of the base member and flange members of the second set are fixed to two opposed sidewalls of the telescopic member.

9. Components according to claim 7 wherein hinge axes for the first set of flange members are located parallel the vertical edges of the telescopic member.

10. Components according to claim 7 wherein the first and second sets of flange members are pivotable to positions flush with the sidewalls of the respective base and telescopic members.

11. Components according to claim 7 wherein hinge pins for the first set of flange members are located adjacent diametrically opposite corners of the base member and, similarly, hinge axes for the second set of flange members are located adjacent diametrically opposite corners of the telescopic member.

12. Components according to claim 7 wherein hinge pins for the first set of flange members are located adjacent opposite corners of the same sidewall of the base member and, similarly, hinge axes for the second set of flange members are located adjacent opposite corners of the same sidewall of the telescopic member.

13. An adjustable stanchion for supporting flexible sidewalls of a temporary wall structure to environmentally isolate a selected area of a room from the remainder of the room comprises:

a tubular base member;

a telescopic member that is extendably received in the tubular base member;

a first set of flange members mounted to at least one side of the tubular base member to provide planar surfaces that extend parallel to the longitudinal axis of the base member; and a second set of flange members hinged to at least one side of the telescopic member to provide planar surfaces that extend parallel to the longitudinal axis of the telescopic member in generally vertical alignment with the first set of flange members.

14. An adjustable stanchion according to claim 13 wherein the flange members of the second set are located for pivotable movement to a position flush against the sides of the telescopic member.

15. An adjustable stanchion according to claim 13 including magnetic material bonded to the planar surfaces of the first and second sets of flange members.

16. An adjustable stanchion according to claim 13 wherein the base member and the telescopic member are both generally rectangular in transverse cross-section.

17. An adjustable stanchion according to claim 16 wherein hinge axes for the hinged flange members of the second set are located parallel to two of the vertical edges of the telescopic member.

18. An adjustable stanchion according to claim 17 wherein said two edges are diametrically opposed relative to the transverse cross-section of the stanchion.

19. Components according to claim 13 wherein a foot plate is pivotably mounted to the lowermost end of the base member to distribute the load of the stanchion means across a floor.

* * * * *

UNITED STATES PATENT AND TRADEMARK OFFICE

CERTIFICATE OF CORRECTION

PATENT NO. : 4,731,961

DATED : March 22, 1988

INVENTOR(S) : Richard R. Bona

It is certified that error appears in the above-identified patent and that said Letters Patent is hereby corrected as shown below:

Column 1, line 49, "know" should be --known--.

Column 3, line 31, "is" should be deleted.

Column 3, line 50, "2" should be --21--.

Column 4, line 2, "surface" should be --surfaces--.

Column 5, line 14, "b" should be --by--.

Column 6, line 19, "surface" should be --surfaces--.

Column 6, line 21, "surface" should be --surfaces--.

Signed and Sealed this

Sixth Day of September, 1988

*Attest:*

DONALD J. QUIGG

*Attesting Officer*

*Commissioner of Patents and Trademarks*